US005588655A

United States Patent [19]

Slupskiy

[11] Patent Number: 5,588,655

[45] Date of Patent: Dec. 31, 1996

[54] VOLLEYBALL TRAINING DEVICE

[76] Inventor: Leontiy Slupskiy, 240 Mt. Vernon Pl., #4D, Newark, N.J. 07106

[21] Appl. No.: 554,354

[22] Filed: Nov. 6, 1995

[51] Int. Cl.[6] ..... A63B 69/00

[52] U.S. Cl. ..... 473/429; 473/459

[58] Field of Search ..... 273/411, 413, 273/26 E, 29 A

[56] References Cited

U.S. PATENT DOCUMENTS

| | | | |
|---|---|---|---|
| 3,731,926 | 5/1973 | Vincent | 273/26 E |
| 3,897,950 | 8/1975 | Keller | 273/411 |
| 4,372,561 | 2/1983 | Morgan et al. | 273/411 |
| 4,881,742 | 11/1989 | Hargreave | 273/413 |
| 4,948,150 | 8/1990 | Daly, Jr. et al. | 273/411 |
| 5,060,946 | 10/1991 | Taylor | 273/411 |
| 5,238,251 | 8/1993 | Staka | 273/411 |

*Primary Examiner*—William H. Grieb

[57] ABSTRACT

A volleyball training device has a bracket, a turnable support turnably mounted on the bracket turnably about an axis, at least one ball, a ball holder which holds the ball and is connected with the turnable support so as to turn together with the latter, the ball holder being formed as a substantially curved element extending in a plane substantially perpendicular to the axis, so that when an attacking strike is delivered by a player against the ball, the ball together with the ball holder and the support is turned about the axis in the plane.

4 Claims, 7 Drawing Sheets

FIG. 1
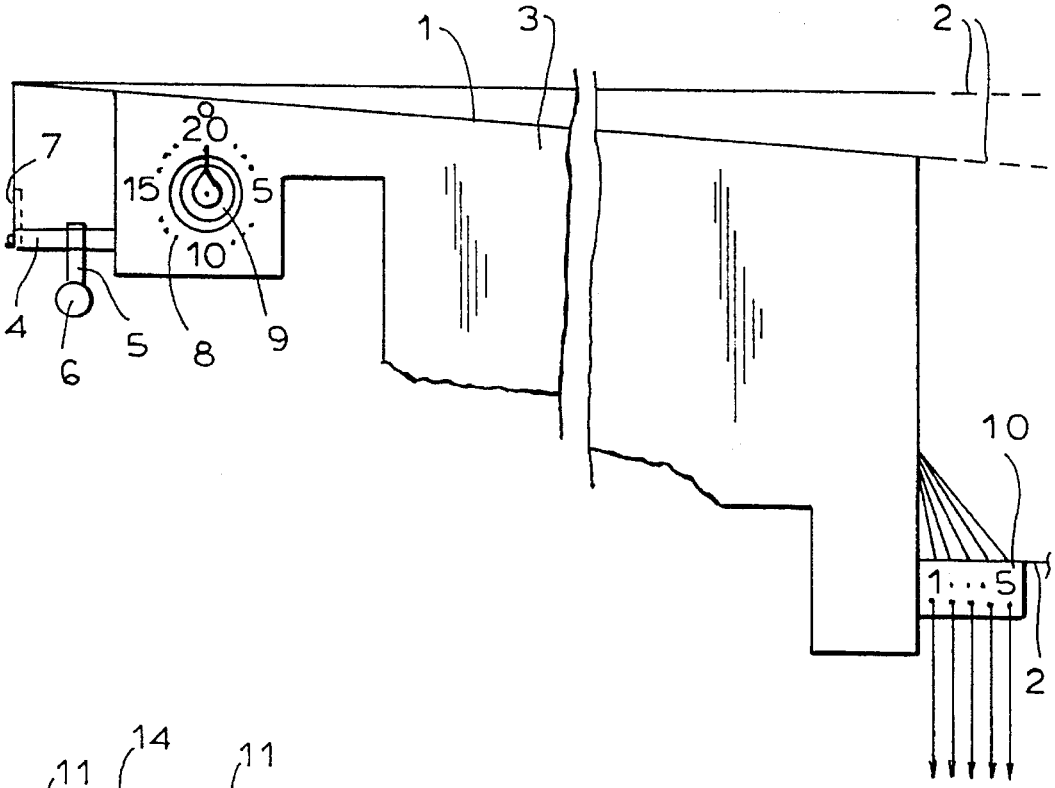
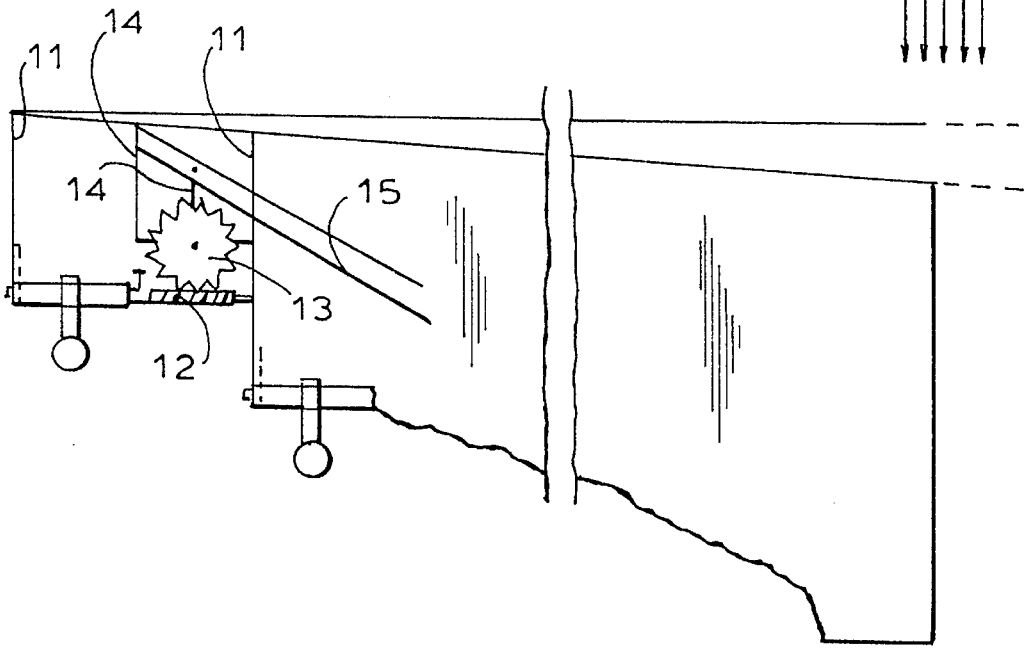
FIG. 2

FIG. 3
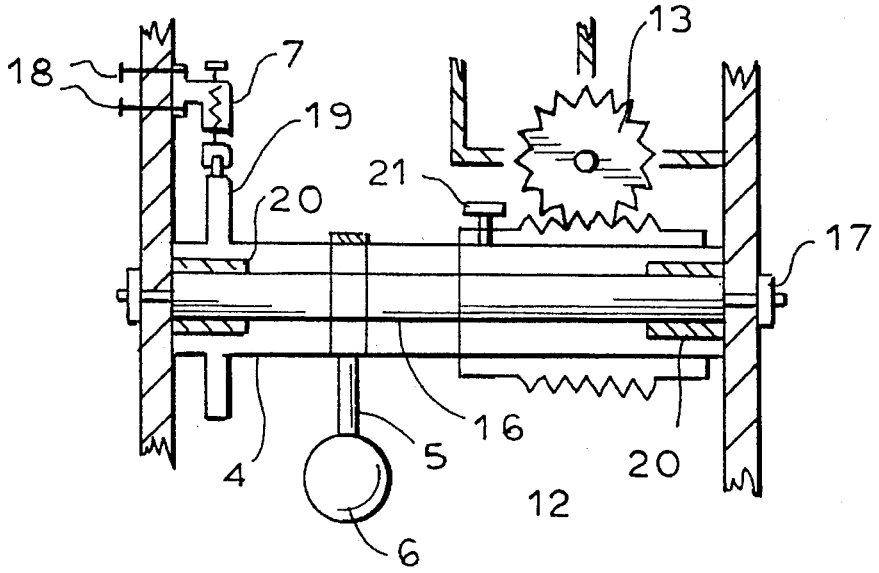
FIG. 4A
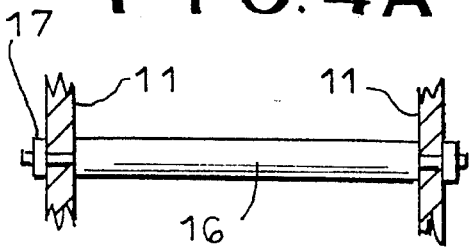
FIG. 4B
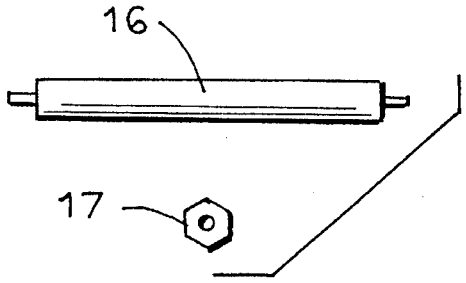
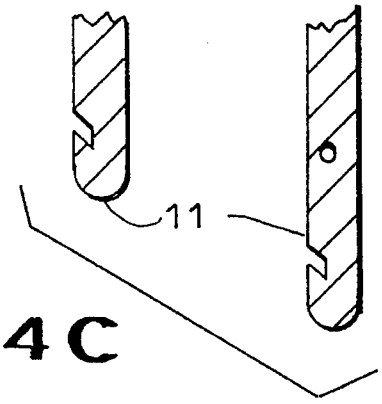
FIG. 4C

FIG.5A
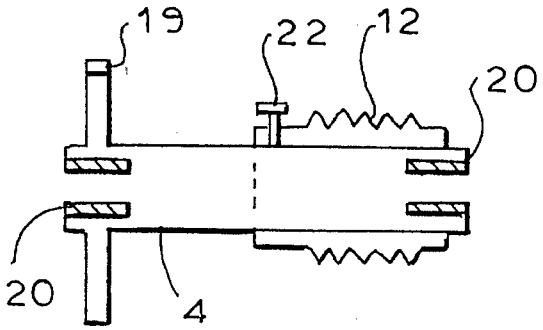
FIG.5B
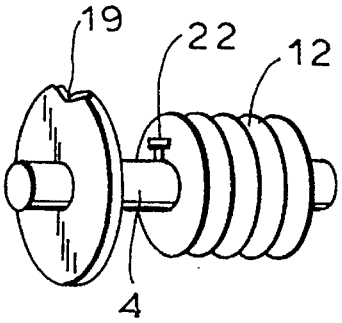
FIG.5C
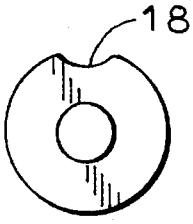
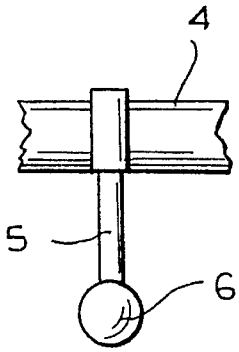
FIG.6A
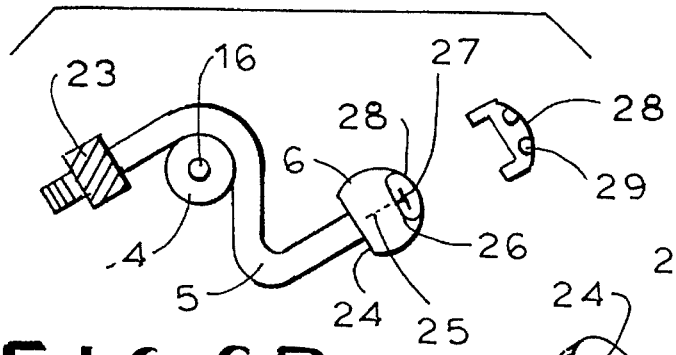
FIG.6B
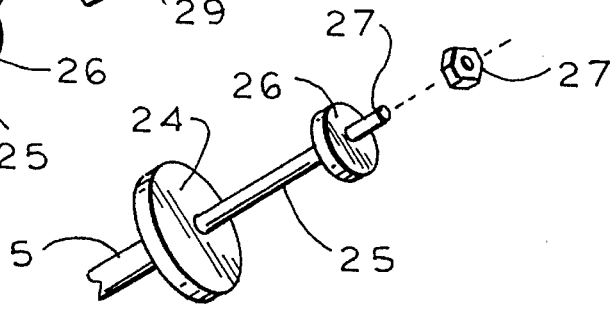
FIG.6C FIG. 7
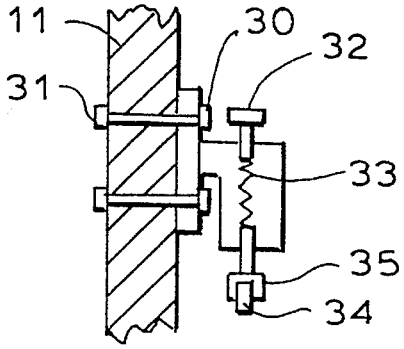
FIG. 9
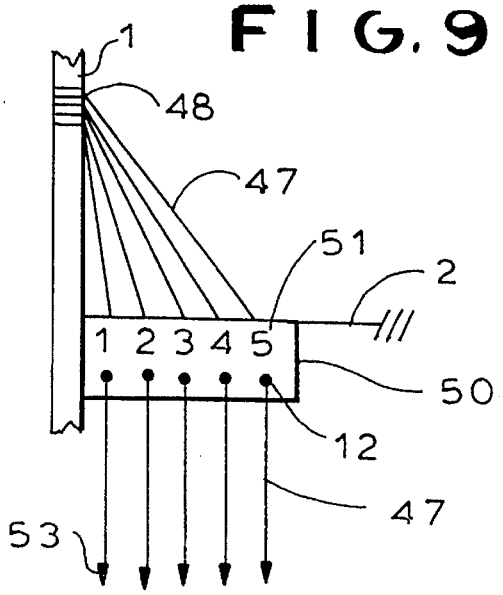
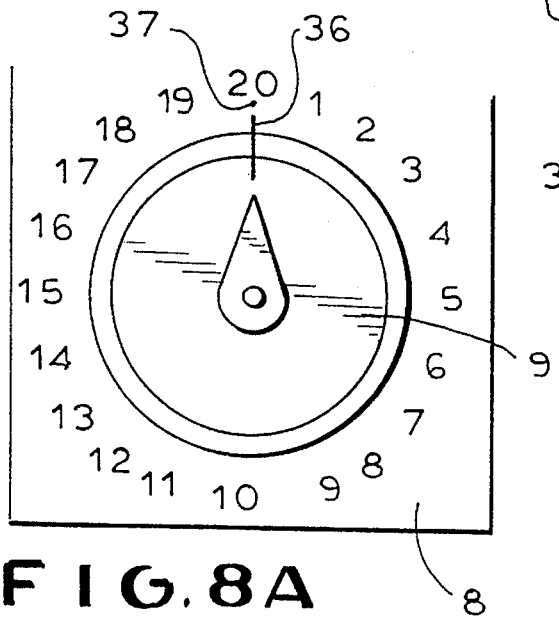
FIG. 8A
FIG. 8B
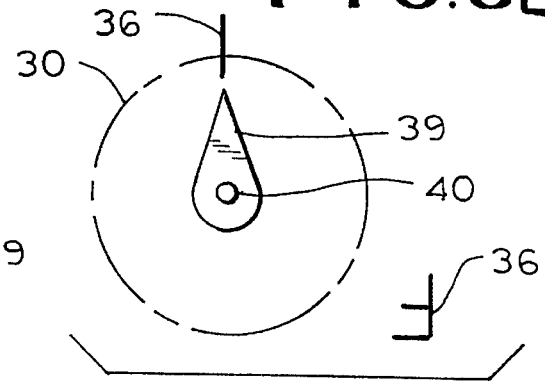
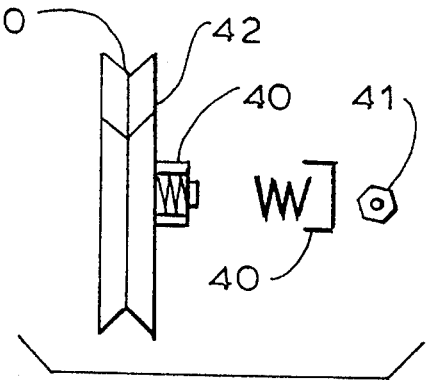
FIG. 8C
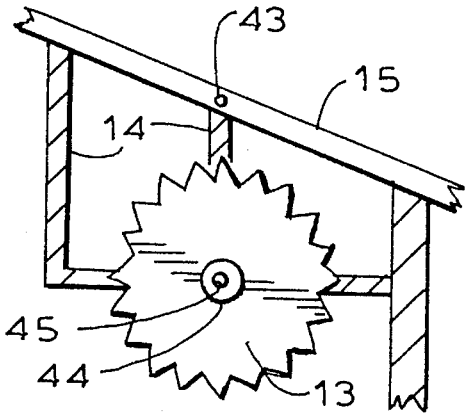
FIG. 8D

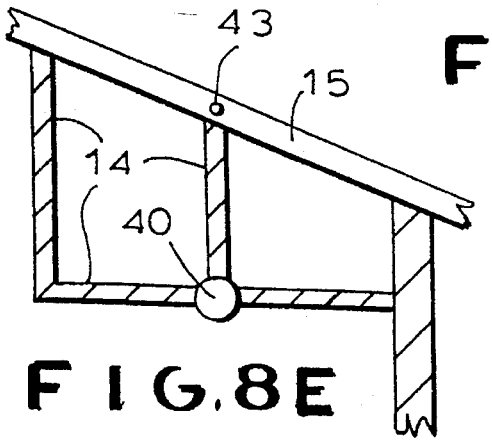
FIG.8E
FIG.8F
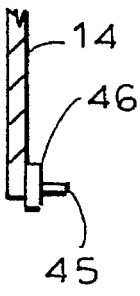
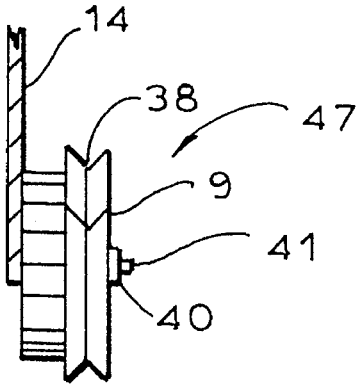
FIG.8G
FIG.12
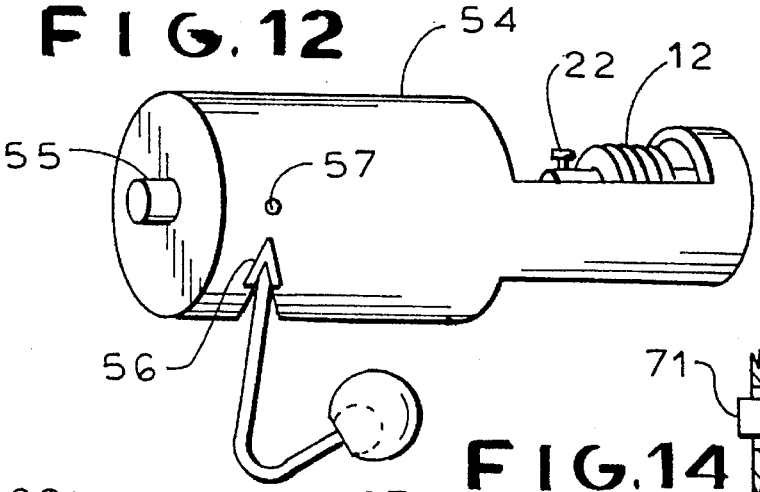
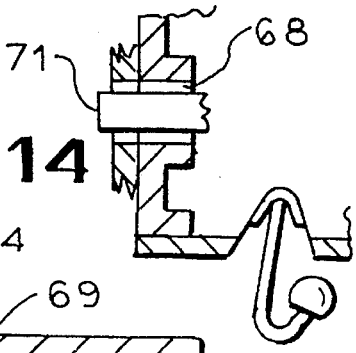
FIG.14
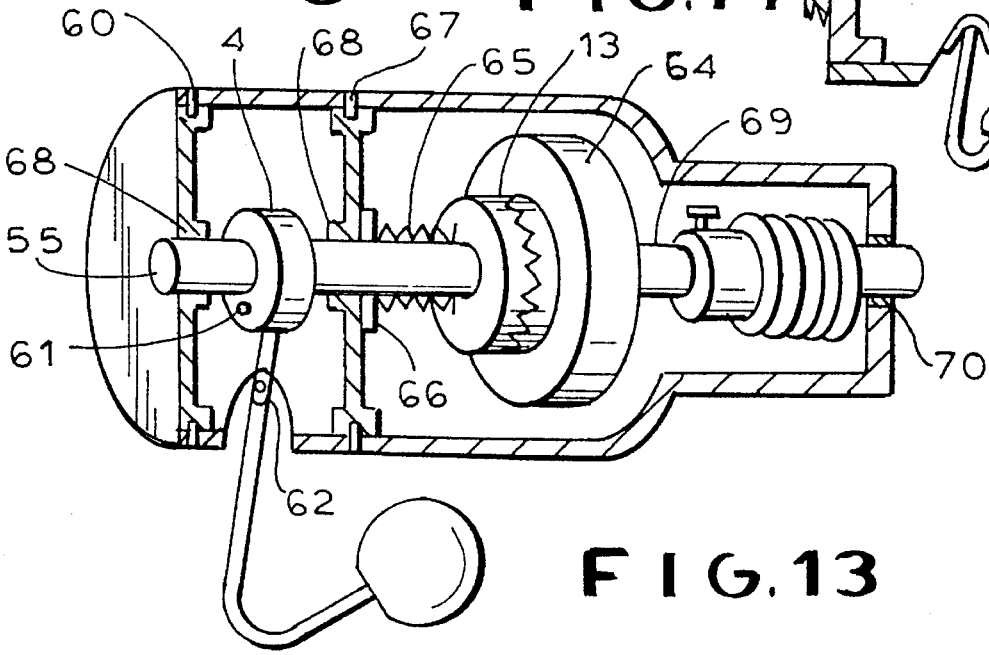
FIG.13

FIG. 10
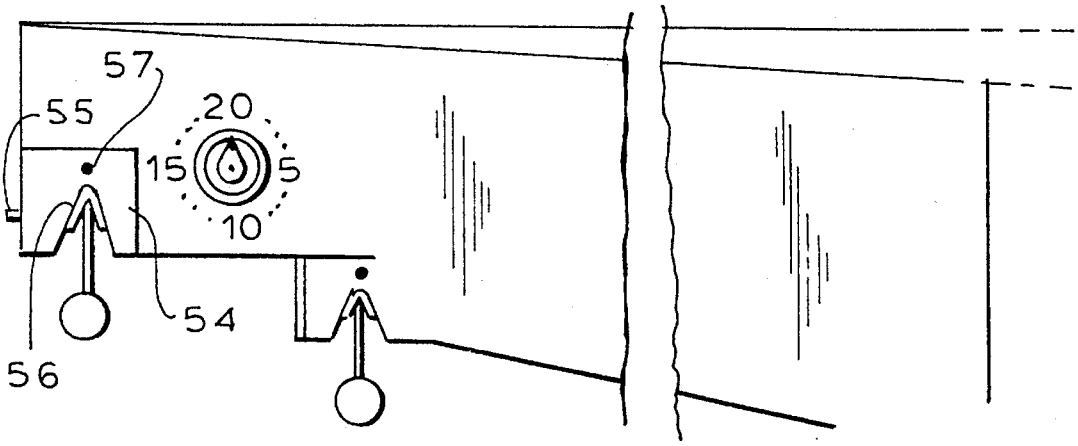
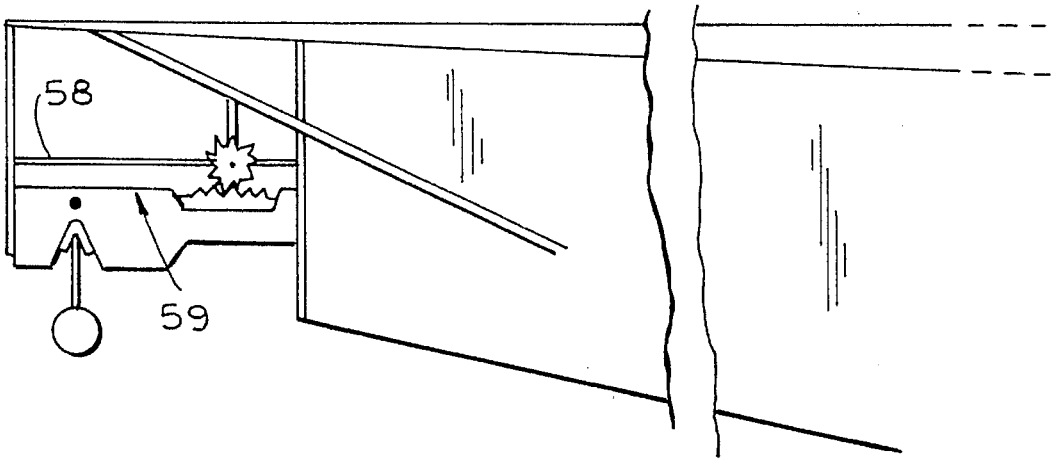
FIG. 11

FIG. 15A
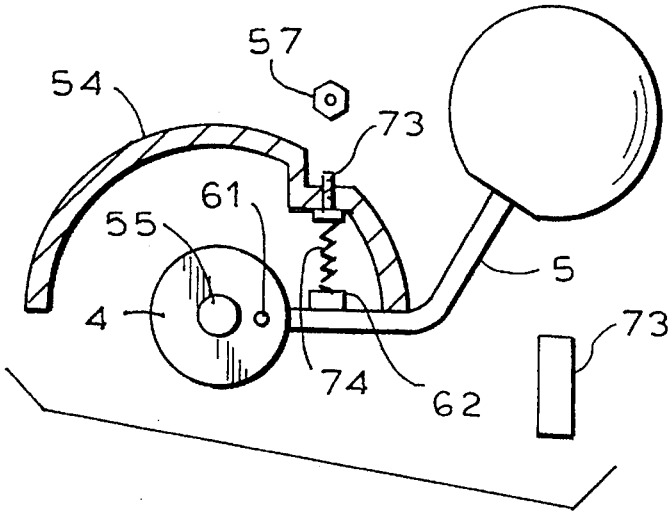
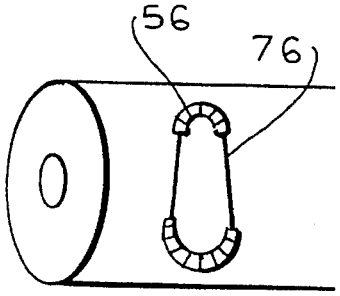
FIG. 15B
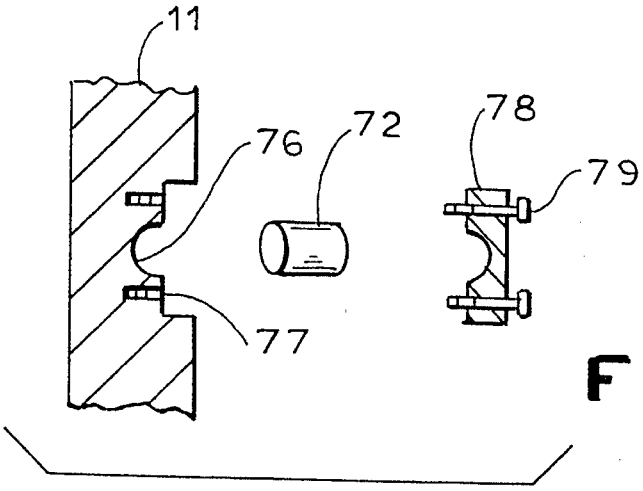
FIG. 16A
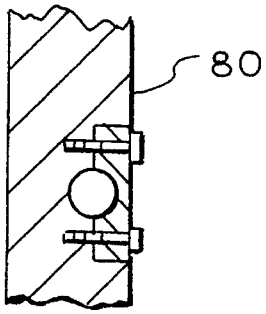
FIG. 16B
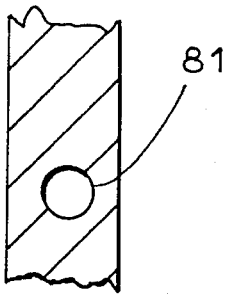
FIG. 16C

VOLLEYBALL TRAINING DEVICE

BACKGROUND OF THE INVENTION

The present invention relates to a volleyball training device.

More particularly, it relates to a device which teaches volleyball players to do attacking strikes.

An attacking strike in volleyball is the most efficient way of scoring and obtaining a serving turn. At the same time, the attacking strike is the most complicated component to learn. The reason for this is that it is very difficult for beginners to form skills to concentrate muscle force so as to perform a whiping or swinging motion with an arm which is substantially similar to the movement of a whip end. This motion is the crux of the efficient volleyball game technique. Attempts have been made to propose training devices of this type. One group of the training devices includes holding a ball by squeezing the ball by side contacts of a special frame manually as disclosed for example in U.S. Pat. No. 3,897,950. In other training devices the ball is fixed laterally on rubber dampers and braces as disclosed in U.S. Pat. No. 4,372,561. In the training devices of another type the ball is suspended in a central upper part as disclosed in U.S. Pat. No. 4,948,150. Finally, there are training devices in which the ball is fixed at one side to a lever-type holder as disclosed in U.S. Pat. No. 5,238,251. While these devices assist in training volleyball players to deliver an attacking strike, they however do not satisfy the main requirement to deliver the strike as needed for highly efficient game. First of all, the known devices do not limit the motion of the arm downwardly. Therefore, a beginner cannot developed a skill to concentrate his muscle forces of the upper body part and the arm to perform an active, whiping movement of the arm. Moreover, irrational skills are developed and fixed with this type of exercising which result in efficient game including strikes to the net or a block. Secondly, the known devices do not provide an objective evaluation of the motion technique which is necessary for a learning control.

U.S. Pat. No. 5,238,251 discloses a solution in which some subjective factors are used for this purpose. However, there are no objective criteria for evaluation of the technique. Thirdly, the known devices always require consulting and assistance by a coach for correcting the movements, or by partners for delivery of the balls as disclosed in U.S. Pat. No. 3,897,950. This results in substantial waste of time. Fourthly, the known training devices have a very limited capacity (only one ball) so that it is not possible to learn complicated motions during the attacking strike by many people. Fifthly, since the known devices do not have objective evaluation, there is no stimulus for the players therefore the training process is not efficient.

Finally, the known devices are utilized near the net in order to more closely imitate the training condition to the natural playing condition. However, it contradicts the main requirement of training in that, it is necessary to form a flexible skill such as a dynamic stereotype in view of high variability of a ball flight in natural playing conditions. The use of the device near the net during the initial stage of training leads to formation of a habit of playing near the net, which is also a negative phenomenon.

SUMMARY OF THE INVENTION

Accordingly, it is an object of the present invention to provide a volleyball training device which avoids the disadvantages of the prior art.

More particularly, it is an object of the present invention to provide a volleyball training device which efficiently develops a rational attacking strike by volleyball players.

It is also an object of the present invention to provide a device which allows a player to concentrate high striking forces in a limited motion of the striking hand and especially the player's arm.

Also, it is an object of the present invention to provide a device of the above mentioned type which allows to objectively control the efficiency of the volleyball player motion.

In keeping with these objects and with others which will become apparent hereinafter, one feature of the present invention resides, briefly stated, in a volleyball training device which has a bracket, a turnable support turnably mounted on the bracket turnably about an axis, at least one ball, a ball holder which holds the ball and is connected with the turnable support so as to turn together with the latter, the ball holder being formed as a substantially curved element extending in a plane substantially perpendicular to the axis, so that when an attacking strike is delivered by a player against the ball, the ball together with the ball holder and the support is turned about the axis in the plane.

When the device in accordance with the present invention has a Z-shaped ball holder mounted on a pivot axis, a volleyball players can deliver a strike at an angle of 135° to the floor surface without a danger of dramatizing his hand. The rotary motion of the ball leads the time of application of force to 15° and as a result a volleyball player develops the ability to transform great muscle forces of the upper body part and the striking arm into an active hand motion. These conditions of training provided by the device not only satisfy the requirements of rational and efficient technique but also satisfy the requirements of the actual game in which an extensive contact of the hand with the ball can lead to a negative result in striking the opponent.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a side view of the device in accordance with the present invention;

FIG. 2 is the side view of the inventive device without a front panel;

FIG. 3 is a transverse cross-section of a mechanism of the inventive device;

FIGS. 4A, 4B and 4C are views showing an axle for fixing a section of a device bracket and for turning a ball holder;

FIG. 5A, 5B and 5C are a section, a perspective view and an end view of a base part of the ball holder;

FIGS. 6A, 6B and 6C are a cross-section, a side view and a perspective view of the ball holder with a ball of the inventive device;

FIG. 7 is a view showing a unit for fixing the ball in a striking position;

FIGS. 8A–8G are views showing details of the unit for counting ball revolutions;

FIG. 9 is a view showing a control board with an indicator of the ball revolutions;

FIG. 10 is a view showing a further modification of the inventive device;

FIG. 11 is a view substantially corresponding to the view of FIG. 10 but showing a device without the front panel;

FIG. 12 is a view showing a detail of the device of FIG. 10;

FIG. 13 is a view showing a cross-section of the inventive device of FIG. 10;

FIG. 14 is a view showing a unit of returning of the ball holder to the initial position;

FIGS. 15A, 15B are a side view and a perspective view of the inventive device; and FIG. 16A–16C are views showing a fixing unit for fixing the device to a bracket.

DESCRIPTION OF THE PREFERRED EMBODIMENTS

As can be seen from FIGS. 1 and 2, the device in accordance with the present invention has a bracket which is identified with reference numeral 1. It can be formed as a folding metal structure formed as an inverted cone with stepped sections for mounting units of the device. The bracket can be fixed to a wall by a concreting of the extension elements extending outwardly beyond the bracket at the right side. The bracket can have 2 m length, 1.5 m height at the right end and a width 0.3 m. The height of a ball from the floor can be 2 m with differences of the height of subsequent balls 0.1 m.

Reference numeral 2 identifies the point of fixing of the bracket to the wall. The front panel 3 of the bracket can be composed of plastic. The device further has a turnable element 4 which supports a ball holder 5 for a ball 6. The ball holder 5 is fixed in a striking position by the element 7. The front side of the bracket is provided with a ball revolution indicator 8 with an indicator disc 9. The indicator ball revolution has a control panel 10. In the drawings, the first section of the bracket 1 is identified with reference numeral 11.

The turnable member 4 for the ball holder 5 is provided with a worm transmission and a worm gear 12. A toothed gear of a counting device of the ball revolution engages with the worm gear. The bracket can have an additional rod for mounting of an axle of the toothed gear 13. A diagonal U-shaped rod 15 of the bracket sections carries cables for zeroing of the counting mechanism.

In FIGS. 3 and 4 an axle for rotation of the supporting member 4 for the ball holder 5 is identified with reference numeral 16. It is fixed by a nut 17. Nuts 15 fix the support 4. The support 4 is provided with an eccentric disc 19 and sliding bushes 20. A ball 22 fixes the worm gear to the support.

When a player delivers a strike to the ball, the support together with the ball holder and the ball is turned due to the worm gear, and the turning moment is transferred to the toothed wheel of the counting device with the ratio 20:1. The freely rotatable disc together with the indicating scale indicates the number of revolutions. The friction bush and the cable for zeroing, the indicator disc is turned to an initial position and it is fixed by an indicator projection and a rod mounted on the front side of the bracket. The zeroing cable extends from the indicator disc and all cables are adjoined on the control panel. At the rear end of the control panel they have knots to prevent their overstressing and tearing off.

FIG. 5A shows a catch for an eccentric disc, sliding bushes 20 and a bolt 22 for fixing of the worm gear. The support is fitted on an axle of a bracket section and fixedly connected with the ball holder. As can be seen from FIG. 6B, the ball holder has a counterweight 23. A support disc for the fixation of the ball is composed of a light metal or plastic, as well as a rod 25 of the support disc. An upper pressing disc 26 is provided, and a nut 27 is applied at the end. Reference numeral 28 identifies a protective hood for the nut, while the reference numeral 29 identifies an annular depression in the hood.

The ball holder can be composed of a light metal such as titanium and attached to the turnable support for example by welding or bolting. The counterweight provides braking of the ball holder during the last revolution or during a free return fall when the braking wheel of the fixing device gets into a catch of the eccentric disc 19. The difference in weight of the ball and the counterweight can be approximately 20%, or in other words the ball must be heavier by 15–20%. The ball can be composed of a light polyvinyl material and can correspond to approximately two-thirds of the circumference of a regular volleyball with a diameter of 0.2 m.

As can be seen from FIG. 7, the ball is fixed in a striking position by a bolt 30 to the bracket with a nut 31. A spring of the braking wheel 32 is regulated by a bolt 32. Reference numeral 34 identifies a braking wheel, while reference numeral 35 identifies a telescopic holder of the braking wheel. The braking wheel in a striking position is permanently pressed against the eccentric disc 19 of the turnable support of the ball holder and brakes its motion. When the motion is slowed down, it gets into a catch of the eccentric disc during the last revolution or free reverse motion of the disc, fixes it in the striking position or in other words, at an angle of 135° to the floor surface. The braking force of the braking wheel is regulated by the ball 32.

The counting device of the ball revolutions is shown in FIG. 8A–8G. The ball revolution indicator has a stop projection 36 while a supporting rod of the indicator is identified with reference numeral 37. The indicator disc is provided with a cable 38 and a ball revolution indicator is identified with reference numeral 39. The indicator disc has a pressing hood 40 with a counternut 41. The cable for zeroing of indicator is fixed at the location 42 and passes through an inlet opening 43. The toothed gear is provided with a sliding bush 44, and the indicator disc ha an axle 45, while the toothed gear of the counting device has an axle 46. When a strike is delivered against the wall, the turnable support together with the ball holder and ball transmits the ball revolutions to the toothed wheel 13 and the indicator disc. The disc turns to the right and moves the indicator to a certain mark, and at the same time lines the cable on itself.

FIG. 9 shows a control board for the ball revolution indicator. The cables for zeroing of the indicator pass through an opening 48 and are identified with reference numeral 49. The device has a control board 50 with identification of the balls 51. The cables pass through openings 52 of the board and have end thickenings or knots 53. When one of the balls for example ball 1 is stopped, the length of its cable is shortened in accordance with the data of the indicator. The movable disc of the indicator together with the toothed wheel winds the cable on it. In order to return the indicator to an initial position, the indication "20", or in other words to zero the indication, it suffices to pull the end of the cable on the board. Due to the friction bush of the indicator disc, the pressing spring, the braking bolt and its stopping projection, the disc easily returns to its initial position or in other words to the indication "20". In this case, after the stop of the ball rotation the zeroing of the indicator does not occur as a result of the structural defects, the indicator disc is blocked by the knots 53 on the cable ends. The length of the cables form passages through the openings on the board 50 with approximately 0.5 m.

FIG. 10 shows a body of the mechanism which can be composed of plastic with an axle for the ball holder and flywheel drive, a damper for catching and fixing the ball holder 56 in an initial striking position and a nut 57 for fixing the bolt of an upper end of the return spring for the ball holder. This construction is somewhat modified with respect to the construction shown in FIG. 1. In the modified construction without the front panel shown in FIG. 11 an additional rod 58 is provided on the bracket for fixing the body of the mechanism with a bolt 59 for fixing the body. This is more clearly shown in detail in FIG. 12.

As can be seen from FIG. 13 the front cover of the body has an opening 60. A ball 61 fixes the ball holder. The lower end of the return spring of the ball holder is provided with a catch 62. The flywheel 64 is provided with a ratchet mechanism 63 and a pressing spring 65. The spring abuts against a disc 66. An opening 67 is provided for the bolt which fixes the body to a bracket rod. 68 and 70 identify sliding bushes for an axle of the tool holder and an axle of the flywheel 69. Here, the ball does not rotate over 360°, but also over 90°. The strike against the ball causes the turning of the axle of the ball holder 55 and the rotation is transferred to the flywheel 64 through the ratchet mechanism 63. When the rotation is transferred to the toothed wheel of the counting device through the worm gear, the tool holder which moves due to inertia which is a return element 75 and is returned to the initial position under the action of the return spring 74 and a damper catch 56. The mechanism is accommodated in a plastic cylindrical box.

FIGS. 15A, 15B show in detail the return unit for the ball holder to return the ball to the initial position. The damper 56 is provided with an elastic, for example rubber coating. The element 75 can also be provided by a rubber fabric without a dampening in a central part.

Reference numeral 73 identifies a bolt for fixing the upper end of the return spring, while reference numeral 76 identifies a stroke of the ball holder.

The device can be mounted on the bracket 11 as shown in FIGS. 16A–16C. A C-shaped depression is formed in the body of the left rod 76 with a depth corresponding to two-thirds of the length of circumference of the sliding bush of the ball holder axle. A missing one third of the circumference is covered by a supporting member 78 which presses the sliding bush 72 against the bracket by bolts 79. For fixing of the right side of the device, the right supporting of the bracket has an opening with a sliding bush for the flywheel axle. The left supporting rod is identified with reference numeral 80, while the right supporting rod is identified with reference numeral 81.

As can be seen from FIG. 6B, the ball support 5 is substantially Z-shaped, which is exceptionally important for providing a training to deliver a proper strike.

It will be understood that each of the elements described above, or two or more together, may also find a useful application in other types of constructions differing from the types described above.

While the invention has been illustrated and described as embodied in a volleyball training device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A volleyball training device, comprising a bracket; a turnable support mounted on said bracket turnably about its axis; at least one ball; a ball holder which holds said ball and is connected with said turnable support so as to turn together with the latter, said ball holder being formed as a substantially curved element extending in a plane substantially perpendicular to said axis, so that when an attacking strike is delivered by a player against said ball, said ball together with said ball holder and said support is turned about said axis in said plane; and means for counting a number of strikes against the ball, said counting means being connected with said turnable support.

2. A volleyball training device as defined in claim 1, wherein said ball holder is substantially Z-shaped.

3. A volleyball training device as defined in claim 1; and further comprising means for returning said ball to an initial position, said returning means being connected with said turnable support.

4. A volleyball training device as defined in claim 1; and further comprising means for braking of said ball during a return turning of said support together with said ball holder and said ball, said braking means being connected with said support.

* * * * *